US009210739B2

(12) United States Patent
Chabach et al.

(10) Patent No.: US 9,210,739 B2
(45) Date of Patent: Dec. 8, 2015

(54) PTC HEATING DEVICE WITHOUT ELECTRONIC POWER CONTROL

(71) Applicant: IEE INTERNATIONAL ELECTRONICS & ENGINEERING S.A., Echternach (LU)

(72) Inventors: Driss Chabach, Noertange (LU); Raphael Bennes, Haute Kontz (FR); Alain Schumacher, Igel (DE); Werner Bieck, Wiltingen (DE); Matthias Massing, Konz (DE); Joost Ortjens, Ehnen (LU); Sung-Guen Kim, Guri-si (KR)

(73) Assignee: IEE INTERNATIONAL ELECTRONICS & ENGINEERING S.A., Luxembourg (LU)

( * ) Notice: Subject to any disclaimer, the term of this patent is extended or adjusted under 35 U.S.C. 154(b) by 0 days.

(21) Appl. No.: 14/410,586

(22) PCT Filed: Jun. 26, 2013

(86) PCT No.: PCT/EP2013/063439

§ 371 (c)(1),
(2) Date: Dec. 23, 2014

(87) PCT Pub. No.: WO2014/001414

PCT Pub. Date: Jan. 3, 2014

(65) Prior Publication Data

US 2015/0195870 A1 Jul. 9, 2015

(30) Foreign Application Priority Data

Jun. 26, 2012 (LU) ..... 92030

(51) Int. Cl.
*H05B 1/02* (2006.01)
*H05B 3/00* (2006.01)

(Continued)

(52) U.S. Cl.
CPC ..... *H05B 3/0014* (2013.01); *H05B 1/0238* (2013.01); *H05B 1/0272* (2013.01);
(Continued)

(58) Field of Classification Search
CPC ..... H05B 3/12; H05B 3/014; H05B 3/34; H05B 1/0238; H05B 1/0272; H05B 3/342; H05B 2203/006; H05B 2203/011; H05B 2203/013; H05B 2203/02; H05B 2203/029
USPC ..... 219/505, 504, 528, 529, 202, 507, 508, 219/539, 543, 549; 338/22 R
See application file for complete search history.

(56) References Cited

U.S. PATENT DOCUMENTS 4,833,305 A * 5/1989 Mashimo et al. ..... 219/549
6,084,206 A * 7/2000 Williamson et al. ..... 219/212

(Continued)

FOREIGN PATENT DOCUMENTS

WO 0043225 A2 7/2000
WO 2009075676 A2 6/2009

OTHER PUBLICATIONS

International Search Report and Written Opinion issued Oct. 1, 2013 re: PCT/EP2013/063439; citing: WO 00/43225 A2, US 4 833 305 A and WO 2009/075676 A2.

*Primary Examiner* — Mark Paschall
(74) *Attorney, Agent, or Firm* — Cantor Colburn LLP

(57) ABSTRACT

Foil-based PTC heaters are self-regulating, i.e. do not need any electronic control unit (ECU) to limit the maximum heating current. In order to establish different heating power levels the present invention proposes to choose different PTC ratio/onset characteristics. In addition, the print design of the PTC ink can be adjusted accordingly.

14 Claims, 2 Drawing Sheets

(51) Int. Cl.
*H05B 3/12* (2006.01)
*H05B 3/34* (2006.01)

(52) U.S. Cl.
CPC . *H05B 3/12* (2013.01); *H05B 3/34* (2013.01); *H05B 3/342* (2013.01); *H05B 2203/006* (2013.01); *H05B 2203/011* (2013.01); *H05B 2203/013* (2013.01); *H05B 2203/02* (2013.01); *H05B 2203/029* (2013.01)

(56) References Cited

U.S. PATENT DOCUMENTS

| | | | | |
|---|---|---|---|---|
| 2006/0056125 | A1* | 3/2006 | Wang et al. | 361/103 |
| 2006/0152329 | A1* | 7/2006 | Bjorsell | 338/22 R |
| 2013/0136964 | A1* | 5/2013 | Li et al. | 429/62 |

* cited by examiner

PTC HEATING DEVICE WITHOUT ELECTRONIC POWER CONTROL

TECHNICAL FIELD

The present invention generally relates to a PTC (Positive Temperature Coefficient) heating device with multiple power levels and more particularly to a multi-level PTC heating device without electronic power control. Such heater devices are for instance used in power controlled heater applications such as e.g. seat-heater, interior/panel heater, etc.

BACKGROUND ART

In general, power controlled heating devices, such as e.g. seat-heater (SH) devices, require electronic control units in order to establish a set of well-defined heating power levels. In such cases heating control is either done directly via thermostat elements in the supply circuit of the actual heating element or by using a pulsing electronics which regulates the mean heater current by varying the relative ON/OFF time interval of the power supply.

BRIEF SUMMARY

The invention provides for an improved heating device which provides multiple power levels without the necessity of an electronic power control.

A foil-based or textile based PTC heater element for generating heat when connected to an electrical power source comprises an electrically insulating substrate, e.g. a polymer foil and/or a textile material, having a first surface and a second surface. A first buss layer made of a conductive material is applied to said first surface of said substrate, said first buss layer comprising a first buss and a second buss extending generally along opposite sides of a first heating area of said heater element and a number of alternating first electrodes electrically connected to opposite said first and second busses and extending between said first and second busses. A first layer of a first resistive material comprising a first positive temperature coefficient (PTC) material is applied in said first heating area of said heater element such as to provide electrical communication between at least selected ones of said alternating first electrodes.

If an electrical power source is connected to said first and second busses, a current flows e.g. from said first buss to said second buss via the selected ones of said alternating first electrodes and said first resistive material, thereby dissipating heat within said heating area. In order to provides multiple power levels without the necessity of an electronic power control, the heater element preferably comprises a second buss layer made of a conductive material applied to said second surface of said substrate, said second buss layer comprising a third buss and a fourth buss extending generally along opposite sides of a second heating area of said heater element and a number of alternating second electrodes electrically connected to opposite said third and fourth busses and extending between said third and fourth busses. A second layer of a second resistive material is applied in said second heating area of said heater element such as to provide electrical communication between at least selected ones of said alternating second electrodes. Finally the heater element comprises a switching element configured for selectively connecting an electrical power source individually to said first buss layer or said second buss layer or concomitantly to said first buss layer and said second buss layer.

Foil-based PTC heaters are self-regulating, i.e. these heaters do not need any electronic control unit (ECU) to limit the maximum heating current. In order to establish different heating power levels the present invention proposes to choose different PTC ratio/onset characteristics. In addition, the print design of the PTC ink can be adjusted accordingly.

In a preferred embodiment of the invention, the configuration of said second buss layer and said second layer of resistive material is such that a maximum heating power dissipated during operation by said second layer of resistive material is different from a maximum heating power dissipated during operation by said first layer of resistive material. The heater substrate may e.g. be printed on both sides such that, for instance, the upper side provides ⅓ of the maximum heating power and the lower side delivers ⅔ of the specified power. Hence, that type of embodiment allows three heating power levels: 33%, 66% and 100% of the specified maximum power without any Electronic Control Unit ECU.

In preferred embodiments, the present invention offers the possibility to improve the heater performance and enables to:

Adjust the heating level in selective heater areas.

Adjust heater power at different temperature

To increase the heater safety

To improve heater homogeneity by applying several PTC inks with different PTC ratio/onset characteristics.

In a possible embodiment, said second resistive material comprises a second positive temperature coefficient material and wherein a temperature coefficient of said second resistive material is different from a temperature coefficient of said first resistive material. The different temperature coefficients of said first and second resistive materials provide for a different heating characteristic of the upper and the lower side and thus for different heating power levels of the upper side and the lower side of the heater.

Alternatively the second resistive material comprises a resistive material having a resistance with none of minimal temperature dependency. The different material of said first and second resistive materials provide for a different heating characteristic of the upper and the lower side and thus for different heating power levels of the upper side and the lower side of the heater.

In other possible embodiments, the different heating characteristic of said first and second layer may be provided, alternatively or additionally to the above measures, by one or more of the following combinations:

- said first resistive material comprising a first specific resistance and said second resistive material comprising a second specific resistance and said first specific resistance being different from said second specific resistance;
- said first layer of resistive material having a first layer thickness and said second layer of resistive material having a second layer thickness and said first layer thickness being different from said second thickness;
- said first layer of resistive material comprising a plurality of first patches of first resistive material and said second layer of resistive material comprising a plurality of second patches of second resistive material, and an area and/or a width of said first patches of first resistive material being different from an area and/or a width of said second patches of second resistive material.
- a distance between selected ones of said alternating first electrodes being different from a distance between selected ones of said alternating second electrodes.

In a possible embodiment, the heater element further comprises a third layer of a third resistive material, said third layer being applied in said first heating area of said heater element such as to provide electrical communication between selected ones of said alternating first electrodes and/or a fourth layer of a fourth resistive material, said fourth layer being applied in said second heating area of said heater element such as to provide electrical communication between selected ones of said alternating second electrodes. In this embodiment the resistive properties of said third resistive material is preferably different from resistive properties of said first resistive material and/or resistive properties of said fourth resistive material are different from resistive properties of said second resistive material.

The actual available heaters in the market are based only on one type of heating element. Those systems don't offer the possibility to have selective limitation of heater power at a defined temperature and/or at a defined heater location. And most of them have poor homogeneity.

Applying different and selected inks allow solving the above issues. Essential benefits:

- Heating power regulation (comfort) without ECU in selective heater areas (homogeneity).
- Maximum current regulation due to PTC effect (safety) at different temperature levels.
- Lower maximum current level when compared with wire-based systems.
- No high-current pulses on the car circuitry.

It will be appreciated, that the switching element is preferably configured for connecting said first buss layer and said second buss layer in parallel or in series to said electrical power source.

BRIEF DESCRIPTION OF THE DRAWINGS

Further details and advantages of the present invention will be apparent from the following detailed description of several not limiting embodiments with reference to the attached drawings, wherein.

DESCRIPTION OF PREFERRED EMBODIMENTS

The PTC heating elements can be located on both sides of the heater substrate. Depending on the chosen power setting of the occupant either the upper side (side 1) or the lower side (side 2) or both sides will be driven by the heating current. Such an embodiment is for instance schematically represented in FIG. 1.

The specific heating power density will be established by ink resistance ρ, print thickness t and width d of the printed pattern of the respective resistive material.

By acting on ink composition, the threshold of resistance change as a function of temperature and hence heating power can also be adjusted as desired.

Using different PTC inks in one heating element gives the possibility to adjust the heater power at a desired temperature or at desired heater location, e.g. in specific areas of the heater. One can use 2, 3 or even more inks where the first one can stop to heat for example at 30° C., the second at 40° C. and the third at 50° C. etc. . . .

It is also possible to print in one heater different inks with different PTC characteristics in different areas or locations to allow selective heating with one system. Using different PTC inks could also be used to compensate voltage drop e.g. along the busses, and to improve heater homogeneity.

The heating element with the different PTC inks can be connected to single or multiple circuits.

A special embodiment combines a PTC-ink on one side of the substrate with a standard polymer thick film (PTF) layer (carbon or silver ink with none/minor T-dependency) on the other side. In case of parallel connection of both layers the non-PTC layer works as an "almost constant" heat source which may be kept at full operation all the time the heater system is switched on. The PTC print itself would be dimensioned significantly more powerful in order to enable fast time to temperature but will be cut inherently by the strong PTC effect.

In case of serial connection of both layers the PTC works again as self-regulating heating system. The non-PTC layer could be dimensioned more powerful (e.g. simple silver layer only) with the goal to push strongly the heating up regime. Power control/limitation of the non-PTC layer would imperatively be given due to the serial connection to the PTC heater which works as a current limiter device in the same time.

Figure 2:
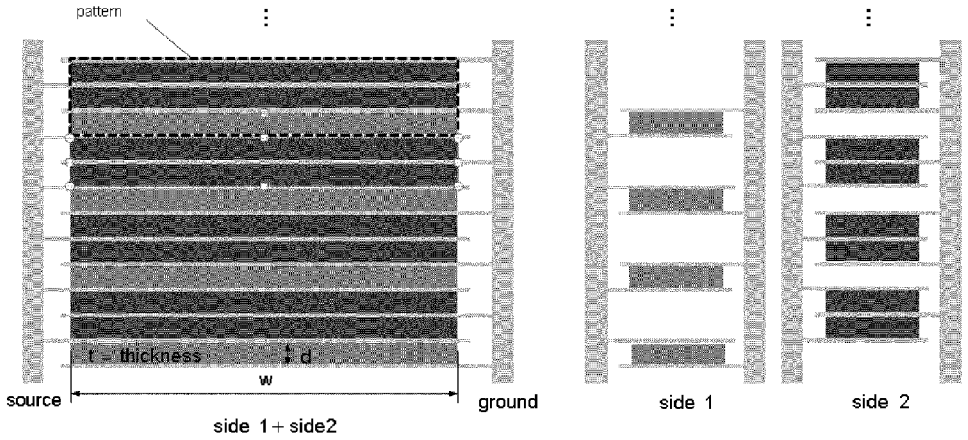
FIG. 2 shows schematically an embodiment of a heater element with different pattern areas on the two sides of the substrate.

In one possible embodiment of the invention, the concept for double-sided heater foil implements the following (see also FIG. 2-4):

- parallel connection of top and bottom print to establish variable power settings
- total power: $P_{total}=P_{side1}+P_{side2}$
  with $P_{side1}=\frac{1}{3}P_{total}$ and $P_{side2}=\frac{2}{3}F_{total}$
- total area: $A_{total}=A_{side1}+A_{side2}$
- constant power density on heated areas:

$$p = \frac{P_{total}}{A_{total}}$$

Figure 1:
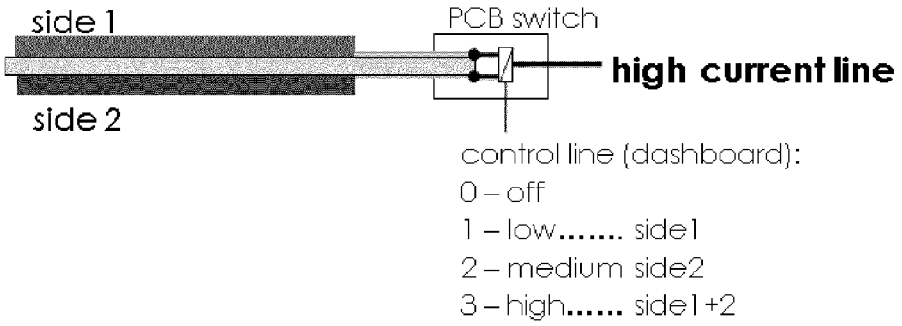
FIG. 1 shows schematically an embodiment of a heater element with different resistive layer properties on the two sides of the substrate.

Under the assumption, that the voltage drop in the bus lines is negligible, the following applies:

$A_{segment}=w\cdot d$ wherein w is the width of the segment, d is the electrode distance $$p = \frac{P_{segment}}{A_{segment}} = \frac{U^2 t}{\rho d^2} = \frac{U^2}{\rho_{sq} d^2}$$

wherein ρ is the spec. resistance of PTC-ink, $\rho_{sq} - \frac{\rho}{t}$ – square resistance of *PTC-ink* and $t$ is the print thickness The electrical interconnection preferably enables to establish three heating power settings (see also FIG. 1). This can be implemented by a simple switch, which enables to selectively connect each side individually or together to the power supply.

In a possible embodiment of the heater configuration, one may use same PTC-ink resistance for both sides. In this case, the printed areas on both sides are preferably different. In the embodiment shown in FIG. 2, the printed area on side 2 is e.g. twice as large than the printed area in side 1.

The main features of this design are:

same PTC-ink resistance for both sides heater pattern n-times repeated, printed area $A_2=2\cdot A_1$ in general, the printed area ratio can take any value $A_2=r_A\cdot A_1$ In another embodiment of the heater configuration (shown in FIG. 3), one may use same PTC-ink resistance for both sides but in this case, the distance between the electrodes on both sides are preferably different.

Figure 3:
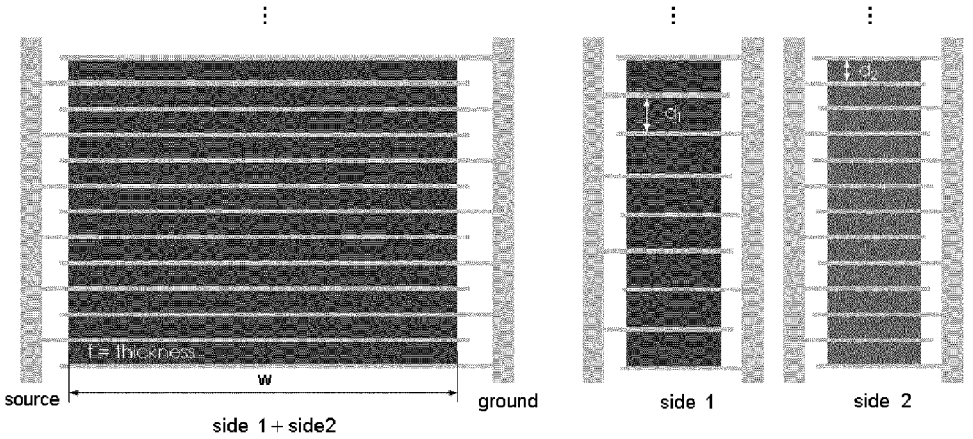
FIG. 3 shows schematically an embodiment of a heater element with different electrode distances on the two sides of the substrate.
Figure 4:
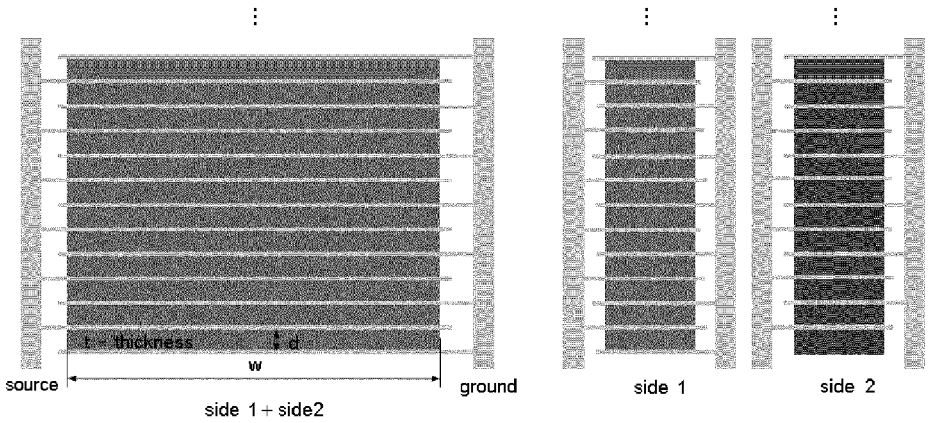
FIG. 4 shows schematically an embodiment of a heater element with different layer thicknesses on the two sides of the substrate.

The embodiment shown in the FIG. 3 implements the following features:

same PTC-ink resistance for both sides full area print, but different electrode distances $d_{1/2}$ with $d_1=\sqrt{2}\cdot d_2$ in general, distance ratio can take any value $d_2=r_d\cdot d_1$ In yet another embodiment (represented e.g. in FIG. 4), one uses different PTC-ink resistances $r_{1/2}$ for both sides. In this embodiment, the printing may be full area prints.

In order to achieve a power distribution of ⅓ to ⅔, the PTC-ink resistances $r_{1/2}$ for both sides may for instance be chosen such that $\rho_1=2\cdot\rho_2$. However it is clear that in general, ink resistance ratio can take any value $\rho_2=r_\rho\cdot\rho_1$.

Figure 5:
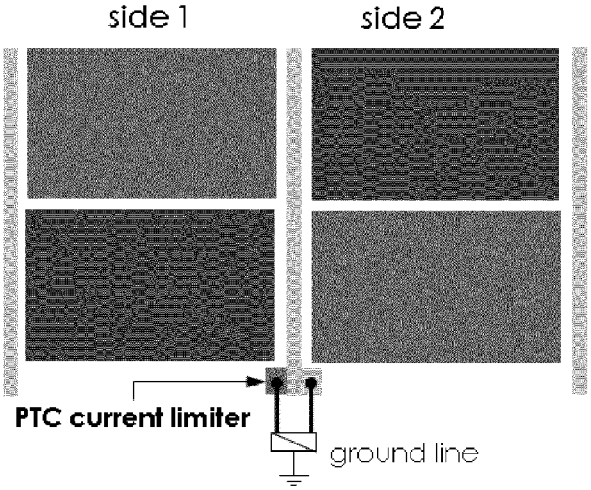
FIGS. 5 and 6 show schematically an embodiment of a heater element with different areas having different materials on the two sides of the substrate.
Figure 6:
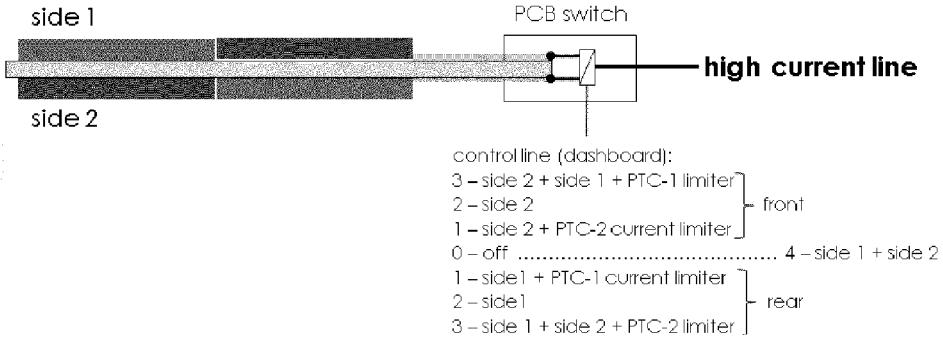

A further embodiment of the electrical interconnection is shown in FIGS. 5 and 6 enables to establish seven heating power settings with additional front/rear variation.

The invention claimed is:

1. A heater element for generating heat when connected to an electrical power source, said heater element comprising:

an electrically insulating substrate having a first surface and a second surface, a first buss layer made of a conductive material applied to said first surface of said substrate, said first buss layer comprising a first buss and a second buss extending generally along opposite sides of a first heating area of said heater element and a number of alternating first electrodes electrically connected to opposite said first and second busses and extending between said first and second busses;

a first layer of a first resistive material, said first resistive material comprising a first positive temperature coefficient material and said first layer being applied in said first heating area of said heater element such as to provide electrical communication between at least selected ones of said alternating first electrodes;

a second buss layer made of a conductive material applied to said second surface of said substrate, said second buss layer comprising a third buss and a fourth buss extending generally along opposite sides of a second heating area of said heater element and a number of alternating second electrodes electrically connected to opposite said third and fourth busses and extending between said third and fourth busses;

a second layer of a second resistive material, said second layer being applied in said second heating area of said heater element such as to provide electrical communication between at least selected ones of said alternating second electrodes; and a switching element configured for selectively connecting an electrical power source individually to said first buss layer or said second buss layer or concomitantly to said first buss layer and said second buss layer.

2. The heater element according to claim 1, wherein a configuration of said second buss layer and said second layer of resistive material is such that a maximum heating power dissipated during operation by said second layer of resistive material is different from a maximum heating power dissipated during operation by said first layer of resistive material.

3. The heater element according to claim 1, wherein said second resistive material comprises a second positive temperature coefficient material and wherein a temperature coefficient of said second resistive material is different from a temperature coefficient of said first resistive material.

4. The heater element according to claim 1, wherein said second resistive material comprises a resistive material having a resistance with none of minimal temperature dependency.

5. The heater element according to claim 1, wherein said first resistive material comprises a first specific resistance and wherein said second resistive material comprises a second specific resistance and wherein said first specific resistance is different from said second specific resistance.

6. The heater element according to claim 1, wherein said first layer of resistive material has a first layer thickness and wherein said second layer of resistive material has a second layer thickness, and wherein said first layer thickness is different from said second thickness.

7. The heater element according to claim 1, wherein said first layer of resistive material comprises a plurality of first patches of first resistive material and wherein said second layer of resistive material comprises a plurality of second patches of second resistive material, and wherein an area and of said first patches of first resistive material is different from an area of said second patches of second resistive material.

8. The heater element according to claim 1, wherein a distance between selected ones of said alternating first electrodes is different from a distance between selected ones of said alternating second electrodes.

9. The heater element according to claim 1, further comprising a third layer of a third resistive material, said third layer being applied in said first heating area of said heater element such as to provide electrical communication between selected ones of said alternating first electrodes, and wherein a resistive property of said third resistive material is different from a resistive property of said first resistive material.

10. The heater element according to claim 1, wherein said switching element is configured for connecting said first buss layer and said second buss layer in parallel or in series to said electrical power source.

11. The heater element according to claim 1, wherein said electrically insulating substrate comprises a polymer foil.

12. The heater element according to claim 1, wherein said electrically insulating substrate comprises a textile material.

13. The heater element according to claim 1, wherein said first layer of resistive material comprises a plurality of first patches of first resistive material and wherein said second layer of resistive material comprises a plurality of second patches of second resistive material, and wherein a width of said first patches of first resistive material is different from a width of said second patches of second resistive material.

14. The heater element according to claim 1, further comprising a fourth layer of a fourth resistive material, said fourth layer being applied in said second heating area of said heater element such as to provide electrical communication between selected ones of said alternating second electrodes, and wherein a resistive property of said fourth resistive material is different from a resistive property of said second resistive material.

* * * * *